US006588841B1

(12) United States Patent
Hoffman et al.

(10) Patent No.: US 6,588,841 B1
(45) Date of Patent: Jul. 8, 2003

(54) GLIDING SEATING UNIT WITH LOCKING UNIT

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 10/136,601

(22) Filed: May 1, 2002

(51) Int. Cl.[7] ..... A47C 3/02

(52) U.S. Cl. ..... 297/270.3; 297/270.2; 297/270.4

(58) Field of Search ..... 297/270.1, 270.2, 297/270.3, 270.4, 281; 248/370, 371

(56) References Cited

U.S. PATENT DOCUMENTS 2,302,387 A * 11/1942 Greeno et al. ..... 248/370
6,106,062 A * 8/2000 Ambrose et al. ..... 297/281
6,120,094 A * 9/2000 Parent ..... 297/270.1
6,213,551 B1 * 4/2001 Desnoyers et al. ..... 297/270.4
6,406,095 B1 * 6/2002 Bouchard et al. ..... 297/281
6,464,295 B1 * 10/2002 Bergeron et al. ..... 297/270.4

* cited by examiner

*Primary Examiner*—Peter R. Brown
(74) *Attorney, Agent, or Firm*—Myers Bigel Sibley & Sajovec

(57) ABSTRACT

A gliding seating unit includes: a base; a seat positioned generally above the base; front and rear swing links attached to the base and seat, the front and rear swing links being constructed and mounted such that the seat is suspended from the base and is free to glide along a longitudinal path; and a locking mechanism attached to the base and seat. The locking mechanism includes: a first engagement member fixed to and below the seat; and a second engagement member pivotally interconnected with the base and configured to engage the first engagement member in one of a plurality of engagement locations. The locking member is configured such that, in the locked position, the second engagement member is raised to engage the first engagement member, and in the unlocked position, the second engagement member is lowered and disengaged from the first engagement member.

25 Claims, 7 Drawing Sheets

GLIDING SEATING UNIT WITH LOCKING UNIT

FIELD OF THE INVENTION

The present invention relates generally to seating units, and relates more particularly to gliding seating units.

BACKGROUND OF THE INVENTION

For many years, rocking chairs have been popular furniture pieces in the home. The repetitive rocking motion of the chair can be quite relaxing and comforting to a seated occupant. In addition, the appearance of the rocking chair can allow it to be used with a variety of furniture styles, particularly traditional styles with a heavy emphasis on visible wood.

In recent years, furniture designers have looked for alternatives to rocking chairs that can provide a similarly relaxing repetitive motion. One alternative has been the gliding chair, or "glider", which includes components that enable the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a mounting structure, such as a bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs on appearance and thus are quite popular. One example of such a glider is illustrated and described in U.S. Pat. No. 5,280,996 to Trent.

One issue that can arise with gliders of this type is that, absent a preventative mechanism, the suspended seat glides freely at all times and can be somewhat unstable. Such unrestricted motion may be undesirable under certain conditions, such as when the occupant would prefer a stable seating unit for comfort, ease of use, or entering on exiting the chair. As a result, some chairs have offered the capability to lock the seat into one or more positions. One approach, exemplified by a gliding chair available from Dutalier, Ltd. (Quebec, Canada), employs a mechanism that includes a member attached to the seat of the chair that has multiple downwardly-extending projections that can engage a rod attached to the base. The projections can be lowered to engage the rod, thereby locking the seat in place. Another approach employs a member attached to the base with projections that extend upwardly to engage a pin attached to the seat, with the pin being able to be lowered to engage the projections and lock the chair in place. However, both of these approaches provide a relatively limited range of positions in which the seat can be locked, and they can be particularly deficient in positions where the seat is well forward of the base, these positions being desirable in assisting elderly or feeble occupants in rising from the chair.

SUMMARY OF THE INVENTION

A gliding seating unit of the present invention may address some of the shortcomings of prior gliding seating units by providing a locking system with multiple locking positions, and in particular locking positions at extreme front and rear locations. The gliding seating unit comprises: a base configured to rest upon an underlying surface; a seat positioned generally above the base; front and rear swing links attached to the base and seat, the front and rear swing links being constructed and mounted such that the seat is suspended from the base and is free to glide along a longitudinal path responsive to a longitudinally-directed force; and a locking mechanism attached to the base and seat. The locking mechanism is movable between locked and unlocked positions, wherein in the unlocked position, the seat frame is free to glide along the longitudinal path, and in the locked position, the seat frame is prevented from gliding along the longitudinal path. The locking mechanism comprises: a first engagement member fixed to and below the seat; and a second engagement member pivotally interconnected with the base and configured to engage the first engagement member in one of a plurality of engagement locations. Engagement of the first and second engagement members at each of the plurality of engagement locations corresponds to a different relative position of the seat and base along the longitudinal path. The locking member is configured such that, in the locked position, the second engagement member is raised to engage the first engagement member, and in the unlocked position, the second engagement member is lowered and disengaged from the first engagement member. In this configuration, the gliding seating unit can provide locked positions when the seat is well forward or well rearward of center.

In one embodiment, the locking mechanism includes: the first engagement member described above; a connecting link pivotally interconnected with the first engagement member at a first pivot; a lock swing link pivotally interconnected with the connecting link at a second pivot; a post extending transversely from the lock swing link and configured to be received in one of the engagement pockets; a control link pivotally interconnected with the lock swing link; and a base mounting bracket adapted to be fixed to the base of the seating unit, the control link being pivotally interconnected to the base mounting bracket. The locking mechanism is movable between a locked position, in which the post engages the first engagement member, and an unlocked position, in which the post is disengaged from the first engagement member.

DETAILED DESCRIPTION OF THE INVENTION

Figure 1:
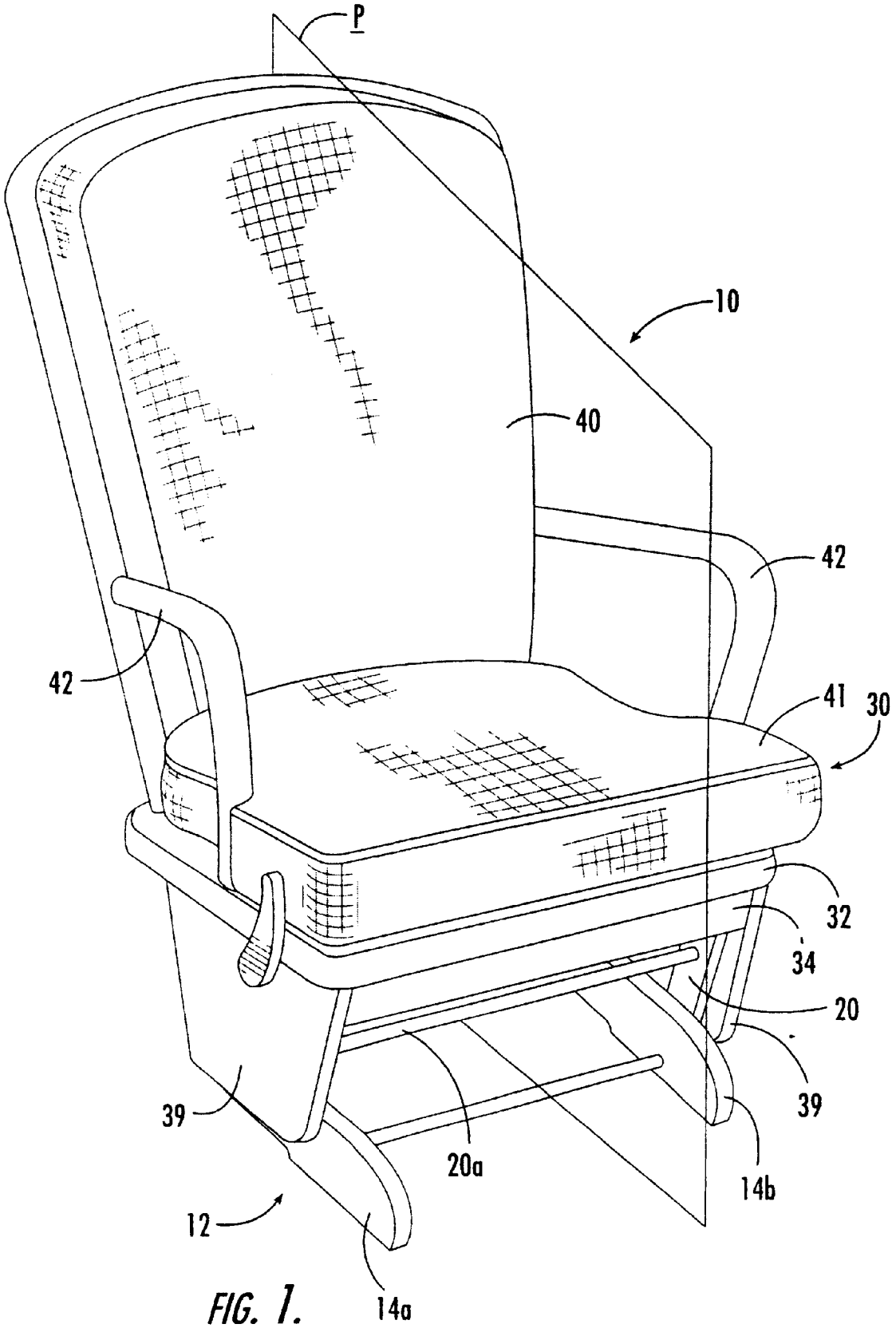
FIG. 1 is a perspective view of a seating unit of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of lines, layers and regions may be exaggerated for clarity.

The present invention is directed to a gliding seating unit having a stationary base and a seat and backrest unit. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the chair. The terms "outward", "lateral" and derivatives thereof refer to the direction defined by a vector originating in the center of the seat and extending in the plane of the underlying surface and perpendicular to the longitudinal directions. The terms "inboard", "inward" and derivatives thereof refer to the direction directly opposite to the outward direction as defined hereinabove. The outward and inward directions together comprise the "traverse" directions relative to the chair.

Also, with only a few exceptions that will be noted herein, the seating unit illustrated and described herein has a vertical plane of symmetry that bisects the base, seat and backrest in longitudinal direction. The description of the seating unit that follows will, in some instances, describe one side of the seating units, with the understanding that those skilled in this art will recognize that this discussion is equally applicable to the opposite side of the seating unit.

Figure 2:
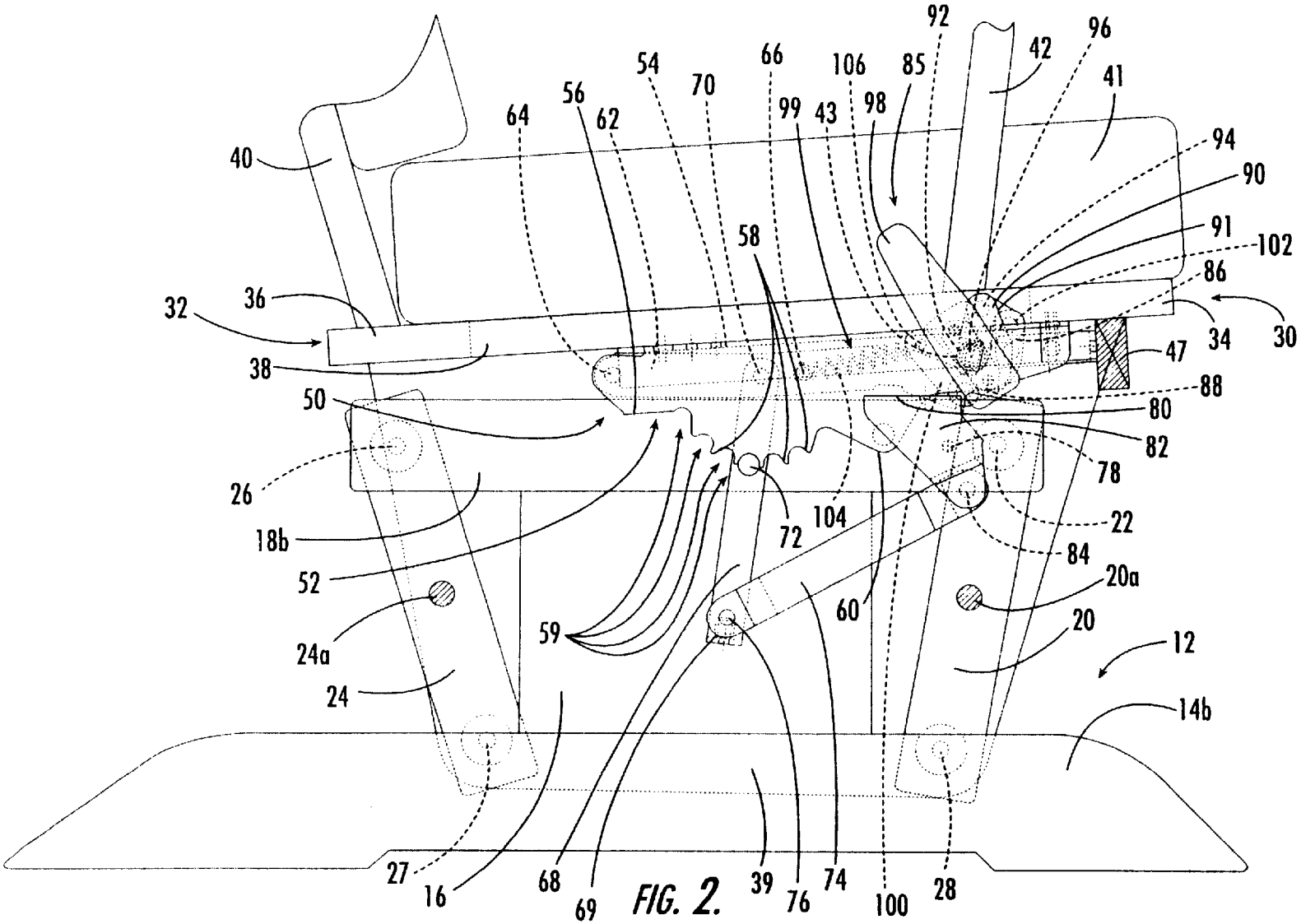
FIG. 2 is a side section view of the seating unit of FIG. 1 with the seat in a central position and the locking mechanism in its locked position.
Figure 3:
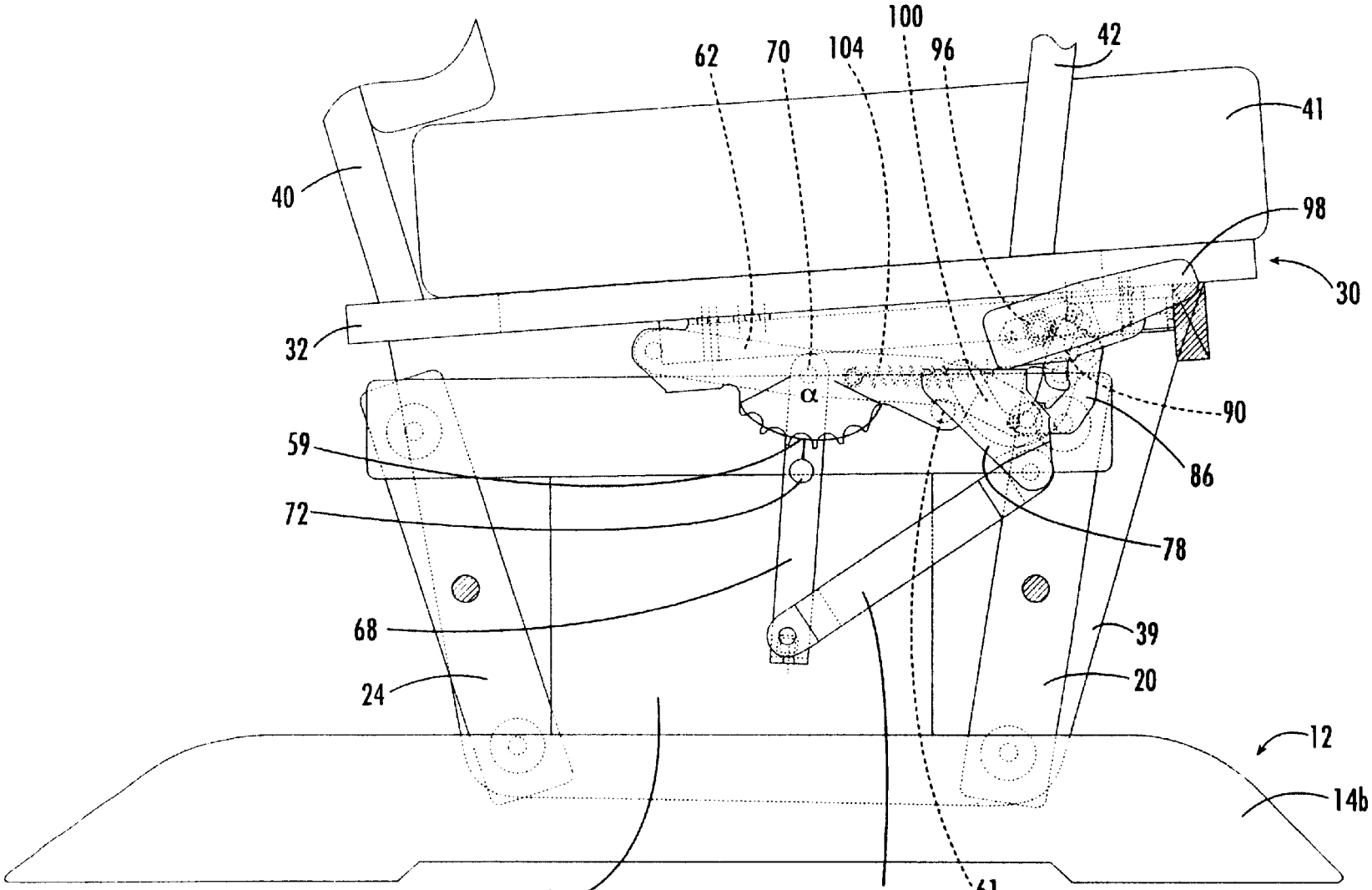
FIG. 3 is a side section view of the seating unit of FIG. 1 with the seat in a central position and the locking mechanism in its released position.
Figure 4:
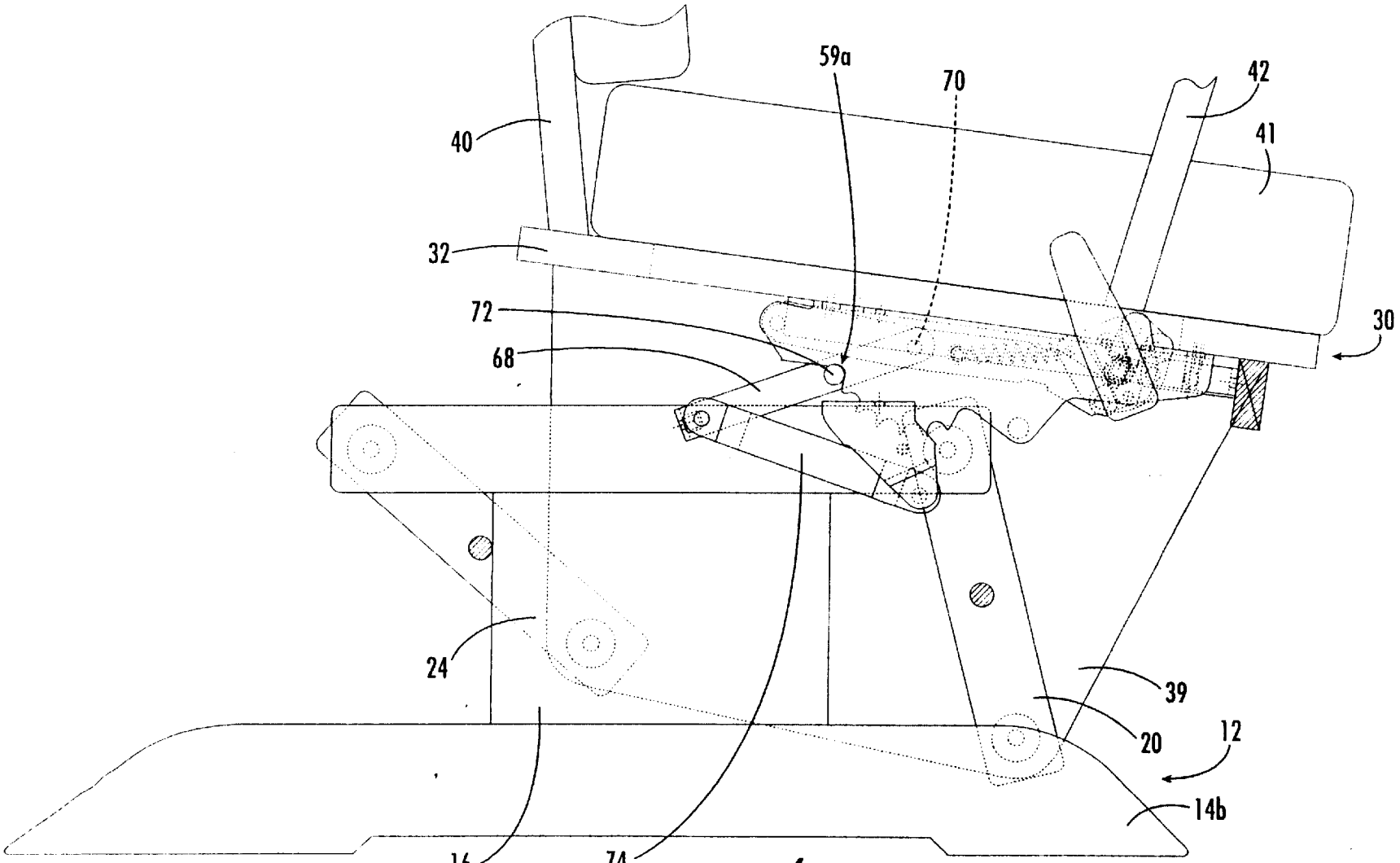
FIG. 4 is a side section view of the seating unit of FIG. 1 with the seat in a forward position and the locking mechanism in its locked position.

Referring now to the drawings, a gliding chair, designated broadly at 10, is illustrated in FIGS. 1 through 6. As best seen in FIGS. 1, 2 and 4, the chair 10 includes a base 12 and a seat 30 that are pivotally interconnected with transversely-separated pairs of front and rear swing links 20, 24 located on each side of the chair 10. These components are described in greater detail below.

The base 12 includes a pair of longitudinally-extending feet members 14*a*, 14*b* that are configured to rest on an underlying surface. An upright tower 16 rises from the feet members 14*a*, 14*b* to upper members 18*b* (only one is shown herein) that are positioned above, respectively, the feet members 14*a*, 14*b*. The upper members 18*b* extend both forwardly and rearwardly of the tower 16 such that the front and rear ends thereof are cantilevered from the tower 16. The upper members 18*b* are connected by a front cross member and a rear cross member (not shown) that provide lateral stability to the base 12.

Those skilled in this art will recognize that other configurations for the base may also be suitable for use with the present invention. For example, the feet members may be replaced with four separate feet, or a single base plate. The tower and upper members may be replaced with other components. Irrespective of its configuration, the base should provide locations, such as the front and rear ends of the upper members 18*b*, from which the pairs of front and rear swing links 20, 24 can be suspended.

Referring still to FIG. 1 and also to FIG. 2, the seat 30 includes a generally horizontal seat platform 32 that provides a support surface for a seated occupant of the chair 10. The seat platform 32 comprises a transversely-extending front plank 34, a transversely-extending rear plank 36, and two longitudinally-extending side planks 38 (one of which is illustrated herein) that connect the outward ends of the front plank 34 to the outward ends of the rear plank 36, thereby forming a window within the seat platform 32. Decking, straps, fabric or the like is stretched across the window to form a supporting deck therein (not shown). A cushion 41 upon which an occupant can sit—then rests on the deck. A backrest 40 extends generally upwardly from the rear plank 36, and two arms 42 extend upwardly from respective side planks 38.

Below the seat platform 32, a longitudinally-extending cover panel 39 extends downwardly from each side plank 38. At their forward ends, each cover panel 39 includes a horizontal axle aperture 43. Also, a front member 47 extends between upper front portions of the cover panels 39 below the front plank 34.

Referring still to FIGS. 1 and 2, the seat 30 is interconnected with the base 12 via the pairs of front and rear swing links 20, 24. More specifically, each front swing link 20 is pivotally interconnected to the front end of its respective upper member 18*a*, 18*b* at a pivot 22 and to the lower front end of its respective cover panel 39 at a pivot 28. The front swing links 20 are attached to a cross-member 20*a* that extends laterally between them; the cross-member 20*a* helps to synchronize the motion of the front swing links 20. Each rear swing link 24 is pivotally interconnected with the lower rear end of its respective upper member 18*a* at a pivot 26 and to the rear end of its respective cover panel 39 at a pivot 27. The rear swing links 24 are attached to a cross-member 24*a* that extends laterally between them and helps to synchronize their motion.

As can be seen in FIG. 2, when the seat 30 is suspended from the base 12, the front swing link 20 extends downwardly and rearwardly from the pivot 22, and the rear swing link extends downwardly and forwardly from the pivot 26. Of course, the front and rear swing links 20, 24 should be of a length (preferably between about 6 and 15 inches) that enables the seat 30 to glide freely along a generally longitudinal path without interference from the base 12. It should also be noted that the front and rear swing links 20, 24 are located outwardly of the upper members 18 and inwardly from the cover panels 39 so that they are free to swing longitudinally without interference from these structures.

Those skilled in this art will recognize that other gliding units that enable a chair to glide may also be suitable for use with the present invention. For example, the pairs of front and rear swing links 20, 24 may be replaced by front and rear glide panels that include living hinges, examples of which are described in U.S. Pat. No. 6,120,095 to Rogers, the disclosure of which is hereby incorporated herein by reference in its entirety.

Pairs of locking mechanisms 50 are attached between the seat 30 and the base 12 to provide different locked positions in which the seat 30 is prevented from gliding relative to the base 12. Each locking mechanism 50 comprises a number of separate, pivotally interconnected links, each of which will be described below. With the exceptions noted, the locking mechanisms 50 are mirror images of each other about the plane P; therefore, only one locking mechanism 50 will be described herein. For clarity, the configurations and orientations of the links will be described first as the locking mechanism 50 is in a central, locked position (exemplified by FIG. 2), with the relative movement of the links of the locking mechanism 50 and the seat 30 as they move being described subsequently. Those skilled in this art will appreciate that the pivots between links can take a variety of configurations, such as pivot pins, rivets, bolt and nut combinations, and the like, any of which would be suitable for use with the present invention.

The locking mechanism 50 is mounted to the seat 30 via a seat mounting bracket 52, which includes a horizontal panel 54 and a vertical panel 56. The horizontal panel 54 is fixed to the underside of the side plank 36. The vertical panel 56 extends downwardly from the lateral edge of the horizontal panel 54. The vertical panel 56 includes a lower projection 60 and a series of downwardly-extending teeth 58 or other projections, between which are defined engagement pockets 59 that define a plurality of engagement locations. The teeth 58 are arranged about an arc $\alpha$ that is between about 1 and 3 inches in radius and 120 to 150 degrees in circumference. The lower projection 60 includes a pin 61 that extends inwardly therefrom.

A slightly bent connecting link 62 is pivotally attached at its rear end to the rear end portion of the vertical panel 56 of the seat mounting bracket 52 at a pivot 64. The connecting link 62 extends generally forwardly therefrom, with its bent portion traveling slightly downwardly at the forward end. A generally centrally located pin 66 extends inwardly.

A lock swing link 68 is pivotally interconnected with the connecting link 62 just rearwardly of the pin 66 at a pivot 70. The lock swing link 68 extends downwardly and slightly rearwardly therefrom. A cross-member 69 extends transversely between lock swing links 68 on opposite sides of the chair 10. Also, a lock pin 72 extends laterally from a central portion of the lock swing link 68; in the locked position shown in FIG. 2, the lock pin 72 nests in one of the pockets 59 formed between the teeth 58 of the seat mounting bracket 58. In the locked position, the pivot 70 is located at or near the center of the arc $\alpha$ created by the teeth 58, and the lock pin 72 is located on the lock swing link 68 at a distance from the pivot 70 that is approximately to the radius of the arc $\alpha$.

A control link 74 is attached at its rearward end to the lower end of the lock swing link 68 at a pivot 76. The control link 74 is generally straight when viewed from the side (as shown in FIG. 2) and extends upwardly and forwardly from the pivot 76 to attach to a base mounting bracket 78. The base mounting bracket 78 includes a horizontal panel 80, which is fixed to the upper surface of the upper member 18*a* of the base 12, and a vertical panel 82, which extends downwardly from the inner edge of the horizontal panel 80. The control link 74 interconnects with a forward portion of the vertical panel 82 at a pivot 84.

Still referring to FIG. 2, the connecting link 62 described above is pivotally interconnected at its forward end to a release unit 85, which includes a drive link 96, a crank 90, an axle 96, and a handle 98. The connecting link 62 is attached to the rear end of the drive link 86 at a pivot 88. The drive link 86 is generally L-shaped and extends first forwardly and upwardly from the pivot 88, then upwardly and slightly rearwardly. The upper end of the drive link 86 terminates at a pivot 94 with the vertical panel 91 of a small crank 90. The crank 90 also includes a horizontally-disposed, inwardly-extending mounting flange 92 that rests on one side of a square axle 96. The axle 96 extends transversely between the cover panels 39 and is inserted into the axle apertures 43 such that it is rotatable about a transverse horizontal axis. On one side of the chair 20, the axle 96 continues laterally beyond the cover panel 39 and terminates at a handle 98.

One of the cranks 90 is also attached to a biasing unit 99, which includes a handle control link 100 and a spring 104. The crank 90 is pivotally interconnected with one end of the handle control link 100 at a pivot 102. The handle control link 100 is generally U-shaped and, in the locked position shown in FIG. 2, describes a generally semicircular profile that enables the axle 96 to nest therein. At its rear end, the control link 100 includes a spring aperture 106. The spring 104 extends between the spring aperture 106 and the pin 66 located on the connecting link 62 inwardly of the connecting link 62. In this position, the spring 104 is in tension.

As noted, when the locking mechanism 50 is in the locked position described above and illustrated in FIGS. 2, 4 and 6, the seat 30 is prevented from gliding motion. To enable the seat 30 to glide along a generally longitudinal path, the locking mechanism 50 is released and moved from the locked position to the unlocked position by the occupant driving the upper end of the handle 98 forward. This movement causes the axle 96 to rotate within the axle apertures 43 (this rotation is clockwise from the vantage point of FIG. 2). Rotation of the axle 96 causes the crank 90 to move similarly. The drive link 86 pivots slightly and moves downwardly, thereby drawing the forward end of the connecting link 62 downwardly until it strikes the pin 61. This downward movement of the connecting link 62 drives the lock swing link 68 downwardly, which disengages the lock pin 72 from its pocket 59. Once the lock pin 72 is disengaged, the seat 30 is free to glide along the longitudinal path defined by the front and rear swing links 20, 24.

As the seat 30 glides, the lock swing link 68 swings with a pendulum-type motion about the pivot 70. This movement draws the lower end of the control link 74 forwardly and rearwardly. The lowering of the lock swing link 68 during unlocking moves the lock pin 72 to a sufficiently low elevation that it does not strike any of the teeth 58 as it swings during gliding.

Figure 5:
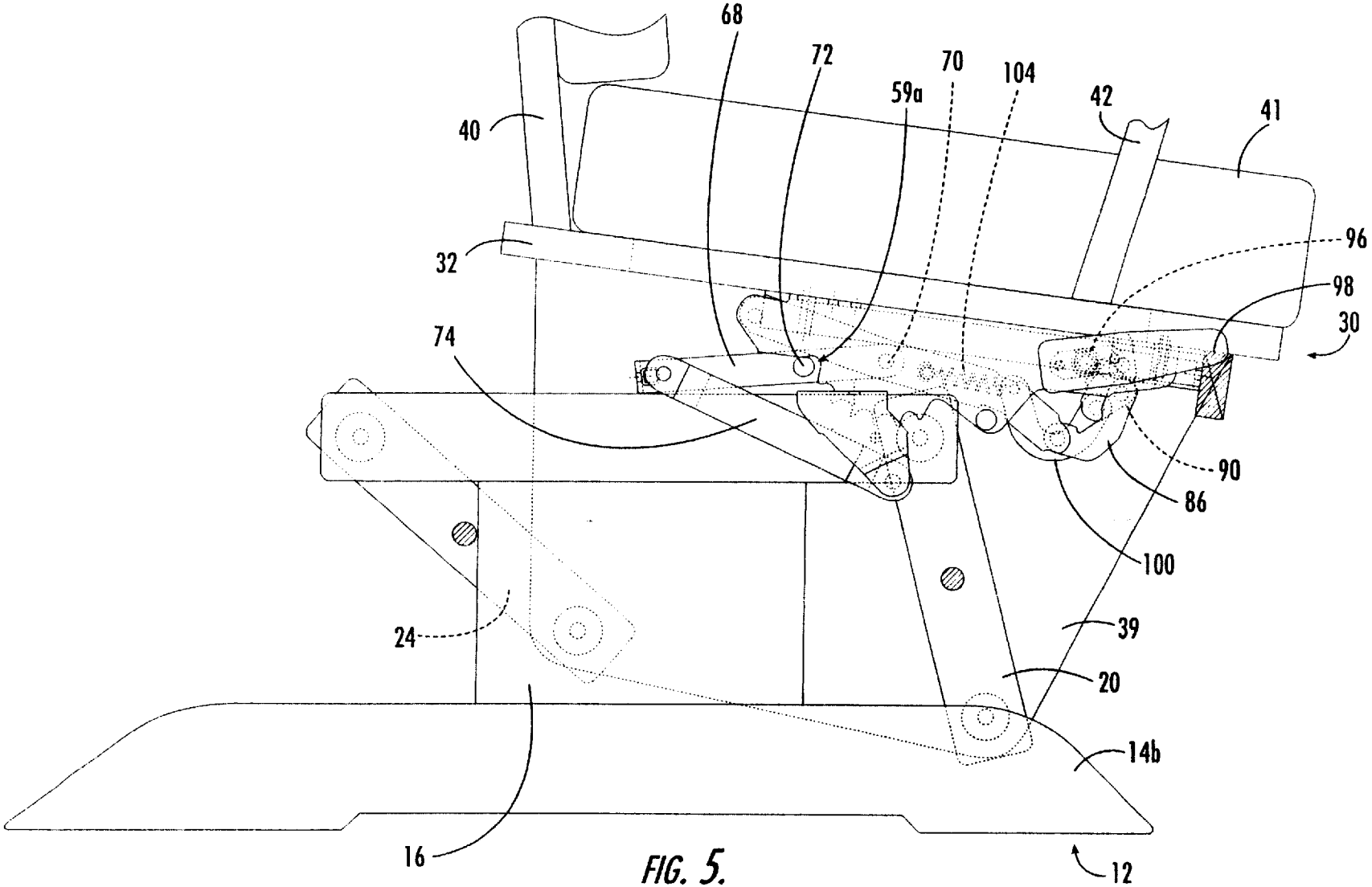
FIG. 5 is a side section view of the seating unit of FIG. 1 with the seat in a forward position and the locking mechanism in its released position.

If desired, the seat 30 may be moved to another position and locked into place. For example, as illustrated in FIGS. 4 and 5, the seat 30 may be moved to a forwardmost position, in which the lower ends of both the front and rear swing links 20, 24 are positioned forwardly of, respectively, the pivots 22, 26. The forward position of the seat 30 draws the handle 98, axle 96, crank 90, drive link 86 and connecting link 62 forward as they remain in their respective orientations taken in the unlocked position. The lock swing link 68 rotates about the pivot 70 such that its lower end rises and moves rearward, as does the lower end of the control link 74. The movement of the lock swing link 68 positions the lock pin 72 rearwardly and slightly below the rearmost pocket 59*a*. Locking movement of the handle 98 (counterclockwise rotation from the vantage point of FIGS. 4 and 5) rotates the axle 96 and crank 90 counterclockwise, which draws the drive link 86 upwardly and the forward end of the connecting link 62 upwardly and slightly forwardly. The movement of the connecting link forces the lock pin 72 into the rearmost pocket 59*a* to lock the chair 10 in place (see FIG. 4). It is preferred that the forwardmost position of the seat 30 is between about 4 and 7 inches of the unlocked, suspended position of the chair so that it may provide assistance for occupants who may struggle to rise from the chair 10 in other positions.

Figure 6:
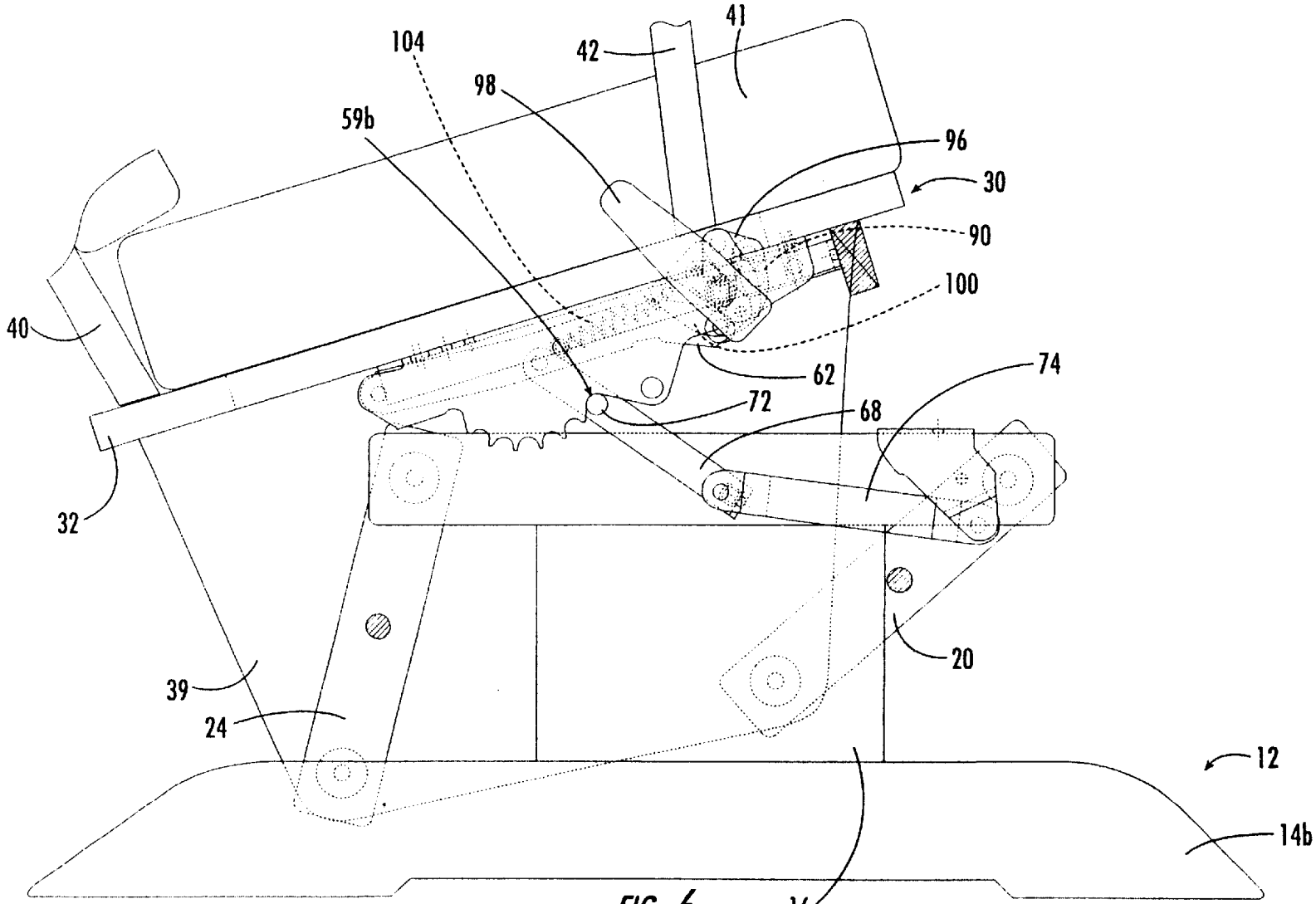
FIG. 6 is a side section view of the seating unit of FIG. 1 with the seat in a rearward position and the locking mechanism in its locked position.
Figure 7:
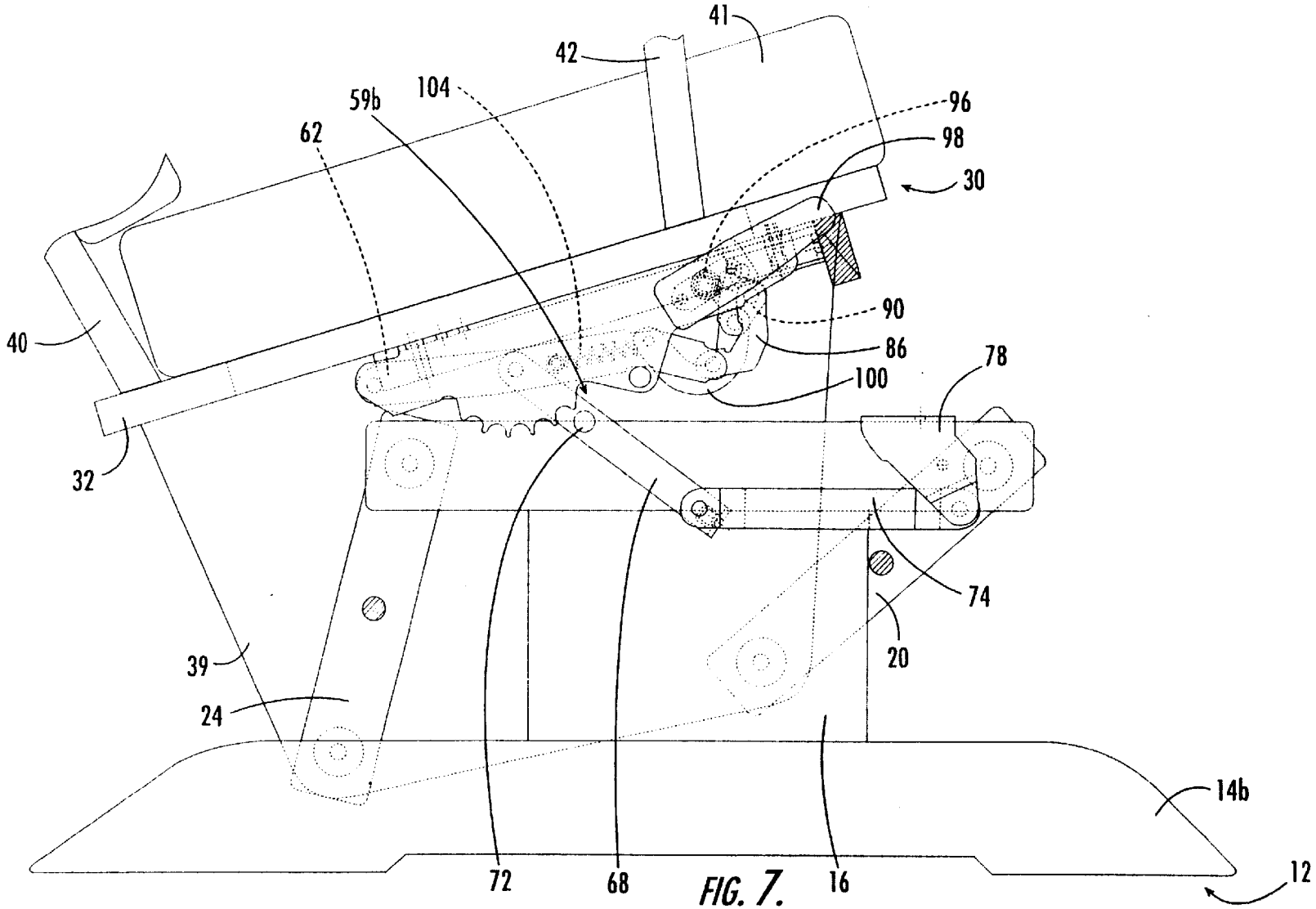
FIG. 7 is a side section view of the seating unit of FIG. 1 with the seat a rearward position and the locking mechanism in its released position.

As another example, the seat 30 may be moved into rearwardmost position and locked. Turning to FIG. 7, the seat 30 is moved to the rear, with the lower ends of the front and rear swing links 20, 24 positioned rearwardly of, respectively, the pivots 22, 26. The rearward position of the seat 30 draws the handle 98, axle 96, crank 90, drive link 86 and connecting link 62 rearward in their respective "unlocked" orientations. The lock swing link 68 is pivoted about the pivot 70 such that its lower end rises and moves forwardly, and the control link 74 rotates about the pivot 84 to a generally horizontal orientation. In this position, the lock pin 72 is located generally beneath the forwardmost pocket 59*b*. The seat 30 can then be locked in place by rotating the handle 98 to the locked position, which brings the crank 90 upwardly and rearwardly and the drive link 86, the forward end of the connecting link 62, and the lock swing link 68 upwardly. This motion raises the lock pin 72 into engagement with the forwardmost pocket 59*b*, thereby locking the seat 30 in position (see FIG. 6).

The skilled artisan will understand that the lock pin 72 may also move to and engage any of the other pockets 59 of the seat mounting bracket 52 (each of which corresponds to a different relative position of the seat and base along the longitudinal path) as desired by the occupant of the chair 10. This can be carried out by moving the seat 30 to the desired position and moving the handle 98 to the locked position as described above. In some embodiments, the distance between the forwardmost and the rearwardmost positions of the seat 30 may be as much as 9 to 14 inches or more.

Irrespective of whether the locking mechanism 50 is in the locked or unlocked position, it is biased in that position by the biasing unit 99. Turning to FIG. 6, which shows the handle 98 in the locked position, it can be seen that the spring 104 applies a rearward force to the rear end of the handle control link 100 (the force being directed along the axis of the spring 104). This rearward force is transmitted to the pivot 102 between the handle control link 100 and the crank 90. The force at the pivot 102 urges the crank 90 to rotate toward the locked position (i.e., to rotate counterclockwise from the vantage point of FIG. 6). Similarly, when the handle 98 is in the unlocked position (see FIG. 7), the spring 104 applies a rearwardly-directed force to the rear end of the handle control link 100 that, again, is transmitted to the pivot 102. When the handle 98 is in the unlocked position, the rearward force in the pivot 102 urges the handle 98 to rotate toward the unlocked position (i.e., to rotate clockwise from the vantage point of FIG. 7). Thus, the locking mechanism 50 is biased toward whichever position (locked or unlocked) it currently resides in, thereby reducing the risk of inadvertently locking or unlocking of the mechanism 50.

It should be understood by those skilled in this art that the locking unit may include additional locking positions, or may omit one or more of the locking positions described and illustrated herein. It should also be appreciated by those skilled in this art that, although a gliding chair is illustrated and described herein, other seating units, including those that serve multiple occupants, can also benefit from the use of the concepts of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, meansplus-function clauses are intended to cover the structures described herein as performing the recited function and not only structural equivalents but also equivalent structures.

That which is claimed is:

1. A gliding seating unit, comprising:

a base configured to rest upon an underlying surface;

a seat positioned generally above the base;

a gliding unit attached to the base and seat, the gliding unit being constructed and mounted such that the seat is suspended from the base; and a locking mechanism attached to the base and seat and movable between locked and unlocked positions, wherein in the unlocked position, the suspended seat is free to glide along a longitudinal path responsive to a longitudinally directed force, and in the locked position, the seat is prevented from gliding along the longitudinal path, the locking mechanism comprising:

a first engagement member fixed to the seat and defining a plurality of engagement locations; and a second engagement member pivotally interconnected with the base and configured to engage the first engagement member in one of the plurality of engagement locations, wherein engagement of the first and second engagement members at each of the plurality of engagement locations corresponds to a different relative position of the seat and base along the longitudinal path;

the locking member being configured such that, in the locked position, the second engagement member is raised to a first elevation to engage the first engagement member, and in the unlocked position, the second engagement member is lowered to a second elevation and disengaged from the first engagement member.

2. The seating unit defined in claim 1, wherein the gliding unit comprises front and rear swing links pivotally interconnected with the seat and base.

3. The seating unit defined in claim 1, wherein the locking mechanism further comprises a lock swing link that is attached to the second engagement member and pivots relative to the first engagement member about a first pivot.

4. The seating unit defined in claim 3, wherein the lock swing link is pivotally interconnected with the base such that, when the chair is in its unlocked position, the lock swing link is free to swing with a pendulum motion about the first pivot.

5. The seating unit defined in claim 4, wherein the locking mechanism further comprises a control link that is pivotally interconnected with the lock swing link and pivotable about a second pivot that is fixed relative to the base.

6. The seating unit defined in claim 3, wherein the locking mechanism further comprises a connecting link that is pivotally interconnected to the first engagement member at a third pivot.

7. The seating unit defined in claim 6, wherein the locking mechanism includes a release unit comprising:

a transversely-extending axle mounting that is rotatable about a generally horizontal axis relative to the seat;

a crank fixed to the axle; and a drive link pivotally attached to the crank and to the connecting link.

8. The seating unit defined in claim 7, wherein the release unit further comprises a handle.

9. The seating unit defined in claim 8, wherein the locking mechanism is configured such that engagement of the post in a forwardmost engagement pocket places the seat in a rearmost position, and engagement of the post in a rearmost engagement pocket places the seat in a forwardmost position, the longitudinal distance between the rearmost and the forwardmost positions of the seat being between about 9 and 14 inches.

10. The seating unit defined in claim 7, wherein the locking mechanism further comprises biasing unit having a handle control link pivotally attached to the crank and a spring attached to the handle control link and to the connecting link.

11. The seating unit defined in claim 10, wherein the seat takes an intermediate suspended position when the locking mechanism is disengaged, and wherein the longitudinal distance between the suspended position and the forwardmost positions of the seat is between about 4 and 7 inches.

12. The seating unit defined in claim 1, wherein the first engagement member includes a plurality of downwardly-extending teeth separated by engagement pockets, each of the engagement pockets defining an engagement location, and wherein the second engagement member comprises a post configured to be received in one of the engagement pockets.

13. A gliding seating unit, comprising:

a base configured to rest upon an underlying surface;

a seat positioned generally above the base;

a gliding unit attached to the base and seat, the gliding unit being constructed and mounted such that the seat is suspended from the base; and a locking mechanism attached to the base and seat and movable between locked and unlocked positions, wherein in the unlocked position, the suspended seat is free to glide along a longitudinal path responsive to a longitudinally-directed force, and in the locked position, the seat is prevented from gliding along the longitudinal path, the locking mechanism comprising:

a first engagement member fixed to the seat, the first engagement member having a plurality of downwardly-extending teeth separated by engagement pockets;

a connecting link pivotally interconnected with the first engagement member at a first pivot;

a lock swing link pivotally interconnected with the connecting link at a second pivot;

a post extending transversely from the lock swing link and configured to be received in one of the engagement pockets; and a control link pivotally interconnected with the lock swing link and pivotable about a third pivot fixed relative to the base.

14. The seating unit defined in claim 13, wherein when the locking mechanism is in the locked position, the second pivot is positioned approximately at the center of the arc.

15. The seating unit defined in claim 14, wherein the gliding unit comprises front and rear swing links pivotally interconnected with the seat and base.

16. The seating unit defined in claim 14, wherein the locking mechanism includes a release unit comprising:

a transversely-extending axle mounting that is rotatable about a generally horizontal axis relative to the seat;

a crank fixed to the axle; and a drive link pivotally attached to the crank and to the connecting link.

17. The seating unit defined in claim 16, wherein the release unit further comprises a handle.

18. The seating unit defined in claim 16, wherein the locking mechanism further comprises a biasing unit having a handle control link pivotally attached to the crank and a spring attached to the handle control link and to the connecting link.

19. The seating unit defined in claim 14, wherein the locking mechanism is configured such that engagement of the post in a forwardmost engagement pocket places the seat in a rearmost position, and engagement of the post in a rearmost engagement pocket places the seat in a forwardmost position, the longitudinal distance between the rearmost and the forwardmost positions of the seat being between about 9 and 14 inches.

20. The seating unit defined in claim 19, wherein the seat takes an intermediate suspended position when the locking mechanism is disengaged, and wherein the longitudinal distance between the suspended position and the forwardmost positions of the seat is between about 4 and 7 inches.

21. The seating unit defined in claim 20, wherein the first pivot is positioned above the teeth of the engagement member, and movement from the locked to the unlocked position causes the first pivot to descend relative to the first engagement member.

22. A locking mechanism adapted to be attached to the base and seat of a seating unit, the seating unit being configured such that the seat is free to glide along a generally longitudinal path relative to the base, the locking mechanism comprising:

a first engagement member adapted to be fixed to the seat, the first engagement member having a plurality of downwardly-extending teeth separated by engagement pockets;

a connecting link pivotally interconnected with the first engagement member at a first pivot;

a lock swing link pivotally interconnected with the connecting link at a second pivot;

a post extending transversely from the lock swing link and configured to be received in one of the engagement pockets;

a control link pivotally interconnected with the lock swing link; and a base mounting bracket adapted to be fixed to the base, the control link being pivotally interconnected to the base mounting bracket;

wherein the locking mechanism is movable between a locked position, in which the post engages the first engagement member, and an unlocked position, in which the post disengaged from the first engagement member.

23. The mechanism defined in claim 22, wherein the second pivot is positioned above the teeth of the engagement member, and movement from the locked to the unlocked position causes the second pivot to descend relative to the first engagement member.

24. The mechanism defined in claim 23, further comprising:

a transversely-extending axle mounting that is rotatable about a horizontal axis relative to the seat;

a crank fixed to the axle; and a drive link pivotally attached to the crank and to the connecting link.

25. The mechanism defined in claim 23, wherein the first engagement member further comprises a stop member that halts the downward movement of the connecting link in the unlocked position.

* * * * *